US012790739B2

(12) United States Patent
Choi et al.

(10) Patent No.: US 12,790,739 B2
(45) Date of Patent: Nov. 10, 2026

(54) CLOTHES CARE APPARATUS

(71) Applicant: SAMSUNG ELECTRONICS CO., LTD., Suwon-si (KR)

(72) Inventors: Jungsang Choi, Suwon-si (KR); Yongpil Park, Suwon-si (KR); Kwonchul Yun, Suwon-si (KR); Kyonghui Jeon, Suwon-si (KR); Hankyu Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 779 days.

(21) Appl. No.: 18/148,923

(22) Filed: Dec. 30, 2022

(65) Prior Publication Data

US 2023/0250574 A1 Aug. 10, 2023

Related U.S. Application Data

(63) Continuation of application No. PCT/KR2022/021343, filed on Dec. 27, 2022.

(30) Foreign Application Priority Data

Feb. 8, 2022 (KR) ..... 10-2022-0016436

(51) Int. Cl.
*D06F 58/10* (2006.01)
*D06F 58/22* (2006.01)

(52) U.S. Cl.
CPC ..... *D06F 58/10* (2013.01); *D06F 58/22* (2013.01)

(58) Field of Classification Search
CPC ..... D06F 58/10; D06F 73/02
See application file for complete search history.

(56) References Cited

U.S. PATENT DOCUMENTS

| | | | | |
|---|---|---|---|---|
| 8,132,339 | B2 | 3/2012 | Moon et al. | |
| 9,303,349 | B2 | 4/2016 | Moon et al. | |
| 10,072,376 | B2 | 9/2018 | Choi et al. | |
| 11,319,664 | B2 | 5/2022 | Chang et al. | |
| 11,453,967 | B2 | 9/2022 | Park et al. | |
| 2009/0151189 | A1 | 6/2009 | Moon et al. | |
| 2010/0083532 | A1* | 4/2010 | Klug | D06F 39/088 34/597 |

(Continued)

FOREIGN PATENT DOCUMENTS

| | | | |
|---|---|---|---|
| CN | 112714811 | A | 4/2021 |
| EP | 3133203 | A1 | 2/2017 |

(Continued)

OTHER PUBLICATIONS

KR-20100099431-A Machine Translation (Year: 2010).*

(Continued)

*Primary Examiner* — Spencer E. Bell

(57) ABSTRACT

Provided is a clothes care apparatus capable of reducing management points and improving productivity. The clothes care apparatus includes a heat exchanger positioned in a machine room, a water collecting duct positioned below the heat exchanger to support the heat exchanger and configured to guide water condensed in the heat exchanger and water discharged from the care room to the machine room, and a sump provided in the water collecting duct and configured to store water guided by the water collecting duct.

14 Claims, 15 Drawing Sheets

(56) References Cited

U.S. PATENT DOCUMENTS

| | | | | |
|---|---|---|---|---|
| 2010/0192397 | A1 | 8/2010 | Kim et al. | |
| 2016/0177490 | A1* | 6/2016 | Park | D06F 37/26 8/137 |
| 2020/0080254 | A1 | 3/2020 | Chang et al. | |
| 2020/0199803 | A1 | 6/2020 | Schurr et al. | |
| 2020/0392664 | A1 | 12/2020 | Choi et al. | |
| 2021/0010193 | A1 | 1/2021 | Oak et al. | |
| 2021/0310179 | A1 | 10/2021 | Seo et al. | |
| 2025/0027261 | A1* | 1/2025 | Kang | D06F 58/206 |

FOREIGN PATENT DOCUMENTS

| | | | | | |
|---|---|---|---|---|---|
| KR | 20100099431 | A | * | 9/2010 | F26B 21/452 |
| KR | 20110067892 | A | | 6/2011 | |
| KR | 10-1295579 | B1 | | 8/2013 | |
| KR | 10-1366274 | B1 | | 2/2014 | |
| KR | 10-1387497 | B1 | | 4/2014 | |
| KR | 101435822 | B1 | | 8/2014 | |
| KR | 101597108 | B1 | | 2/2016 | |
| KR | 101779422 | B1 | | 9/2017 | |
| KR | 10-2020-0030404 | A | | 3/2020 | |
| KR | 10-2162877 | B1 | | 10/2020 | |
| KR | 20200142840 | A | | 12/2020 | |
| KR | 20210007760 | A | | 1/2021 | |
| KR | 10-2021-0073939 | A | | 6/2021 | |
| KR | 10-2021-0111555 | A | | 9/2021 | |
| WO | 2014169955 | A1 | | 10/2014 | |
| WO | 2020101386 | A1 | | 5/2020 | |
| WO | 2021-010658 | A1 | | 1/2021 | |
| WO | 2021-118147 | A1 | | 6/2021 | |

OTHER PUBLICATIONS

International Search Report and Written Opinion of the International Searching Authority dated Apr. 27, 2023, in connection with International Application No. PCT/KR2022/021343, 12 pages.

Supplementary European Search Report dated Nov. 19, 2024, in connection with European Patent Application No. 22926229.0, 8 pages.

Office Action and Search Report issued May 30, 2026, in connection with Chinese Patent Application No. 202280068829.8, 16 pages.

* cited by examiner

CLOTHES CARE APPARATUS

CROSS-REFERENCE TO RELATED APPLICATIONS

This application is a Bypass Continuation of International Application No. PCT/KR2022/021343 filed Dec. 27, 2022, which is based on and claims priority to Korean Patent Application No. 10-2022-0016436 filed Feb. 8, 2022, the disclosure of which is incorporated by reference herein in its entirety.

BACKGROUND

1. Field

The disclosure relates to a clothes care apparatus with an improved water collecting duct.

2. Description of the Related Art

A clothes care apparatus is equipment for clothes care, such as drying wet clothes, removing dust gathered on clothes or smell permeated in clothes, and smoothing out the wrinkles of clothes.

The clothes care apparatus includes a condenser for supplying hot air to a care room in which clothes are accommodated to dry the clothes, and a steam generator configured to perform a refresh function, such as removing the wrinkles of clothes and the like, deodorization, removal of static electricity, etc.

The clothes care apparatus includes a main body forming the care room in which clothes are accommodated. A machine room is positioned below the care room and the steam generator, the condenser, an evaporator, etc. are installed in the machine room. The machine room is separated from the care room.

The clothes care apparatus dries clothes accommodated in the care room through the evaporator included in the machine room, and after the clothes care apparatus dries the clothes, humid air is dehumidified by the evaporator and then again supplied to the care room.

The clothes care apparatus includes a sump for storing condensed water generated by heat exchange in the evaporator and water condensed from a part of a steam discharged to the inside of the care room.

The clothes care apparatus includes a pump for transferring a preset amount of water stored in the sump to a drain container. The drain container is separable from the main body to enable a user to discharge water stored in the drain container to the outside.

SUMMARY

Therefore, it is an aspect of the disclosure to provide a clothes care apparatus for guiding condensed water generated in a heat exchanger and water generated inside a care room to a sump through a water collecting duct.

It is an aspect of the disclosure to provide a clothes care apparatus capable of reducing management points and improving productivity by omitting a drain hose for guiding condensed water generated in a heat exchanger or water generated inside a care room to a sump.

Additional aspects of the disclosure will be set forth in part in the description which follows and, in part, will be obvious from the description, or may be learned by practice of the disclosure.

In accordance with an aspect of the disclosure, a clothes care apparatus includes a heat exchanger positioned in a machine room, a water collecting duct configured to guide water condensed in the heat exchanger and water discharged from a care room to the machine room, and a sump provided in the water collecting duct and configured to store water guided by the water collecting duct.

The water collecting duct may be positioned below the heat exchanger to support the heat exchanger.

The water collecting duct may guide the water discharged from the care room to the machine room directly to the sump.

The water collecting duct may guide the water condensed in the heat exchanger directly to the sump.

The water collecting duct may include an inclined surface inclined downward toward the sump to guide the water condensed in the heat exchanger and the water discharged from the care room to the machine room to the sump.

The sump may be integrated into the water collecting duct.

The sump may protrude from a bottom surface of the water collecting duct toward a bottom surface of the machine room.

The clothes care apparatus may further include a floating magnet provided inside the sump.

The floating magnet may move up and down according to a level of water stored in the sump.

The clothes care apparatus may further include a sensor configured to sense the floating magnet.

The sensor may be positioned outside the sump.

The clothes care apparatus may further include a drain container detachably coupled to the main body and configured to receive water stored in the sump and store the water; and a drain pump configured to transfer the water stored in the sump to the drain container.

According to sensing of an upward movement of the floating magnet by the sensor, the drain pump may operate to transfer the water stored in the sump to the drain container. The clothes care apparatus may further include: a filter configured to filter a foreign material included in water stored in the sump; and a filter accommodating bracket coupled to the water collecting duct to be positioned inside the sump.

The filter accommodating bracket may include a filter accommodating groove configured to accommodate the filter and positioned to correspond to a drain hole that discharges the water stored in the sump.

The filter accommodating bracket may include a stopper positioned above the floating magnet and configured to limit an upward movement range of the floating magnet.

The filter accommodating bracket may include a sump cover configured to cover an open upper side of the sump.

The sump cover may support a portion of the heat exchanger and include a cover hole that discharges the water condensed in the heat exchanger to the sump.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
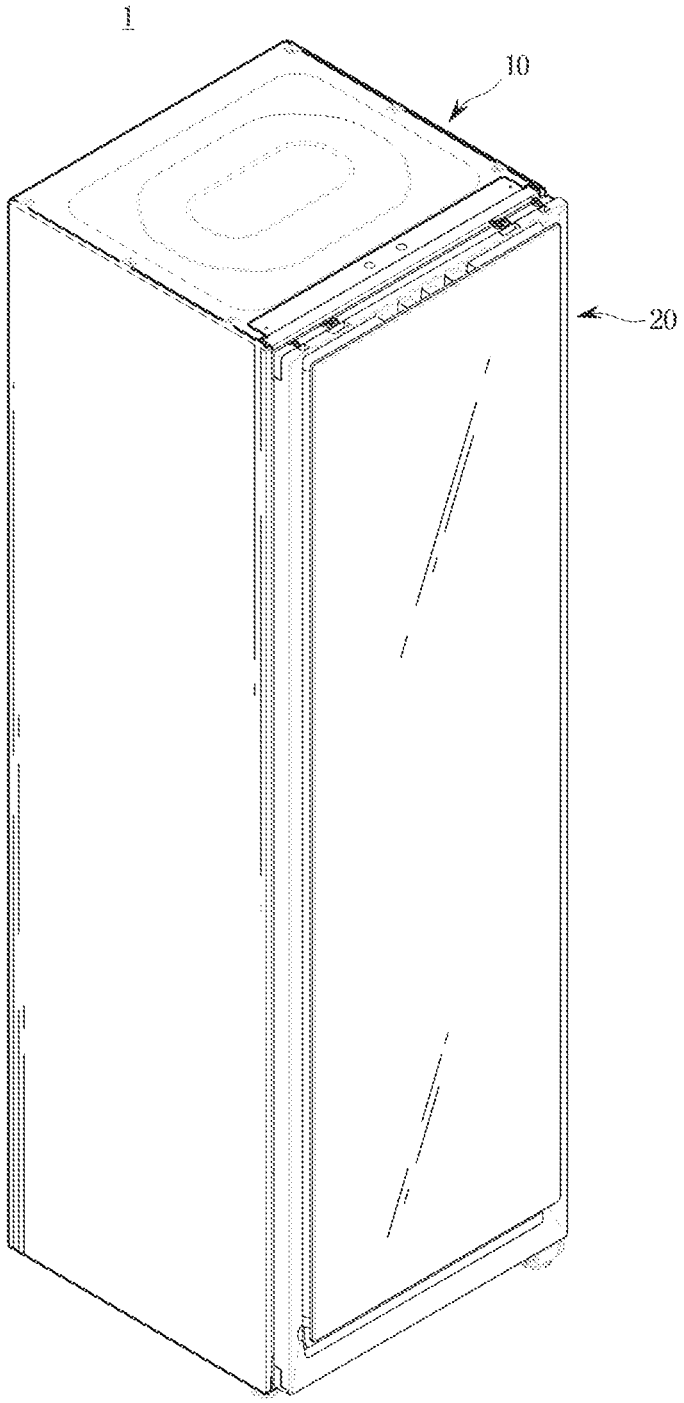
FIG. 1 is a perspective view of a clothes care apparatus according to an embodiment of the disclosure.

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "including" or "having," etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

Also, it will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Throughout the disclosure, the expression "at least one of a, b or c" indicates only a, only b, only c, both a and b, both a and c, both b and c, all of a, b, and c, or variations thereof.

Hereinafter, an embodiment according to a disclosure will be described in detail with reference to the accompanying drawings.

Figure 2:
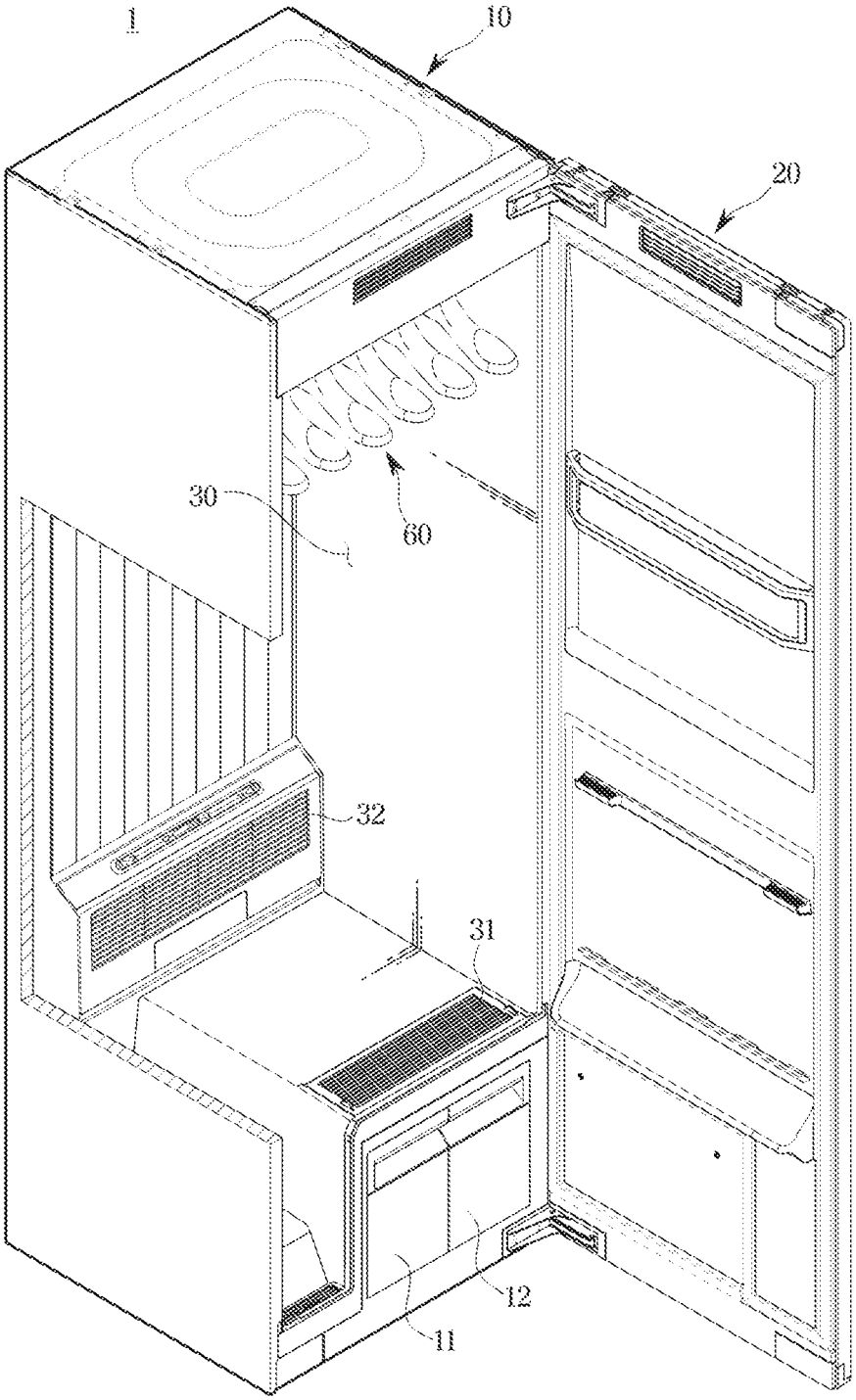
FIG. 2 shows a state in which a door opens in a clothes care apparatus according to an embodiment of the disclosure.
Figure 3:
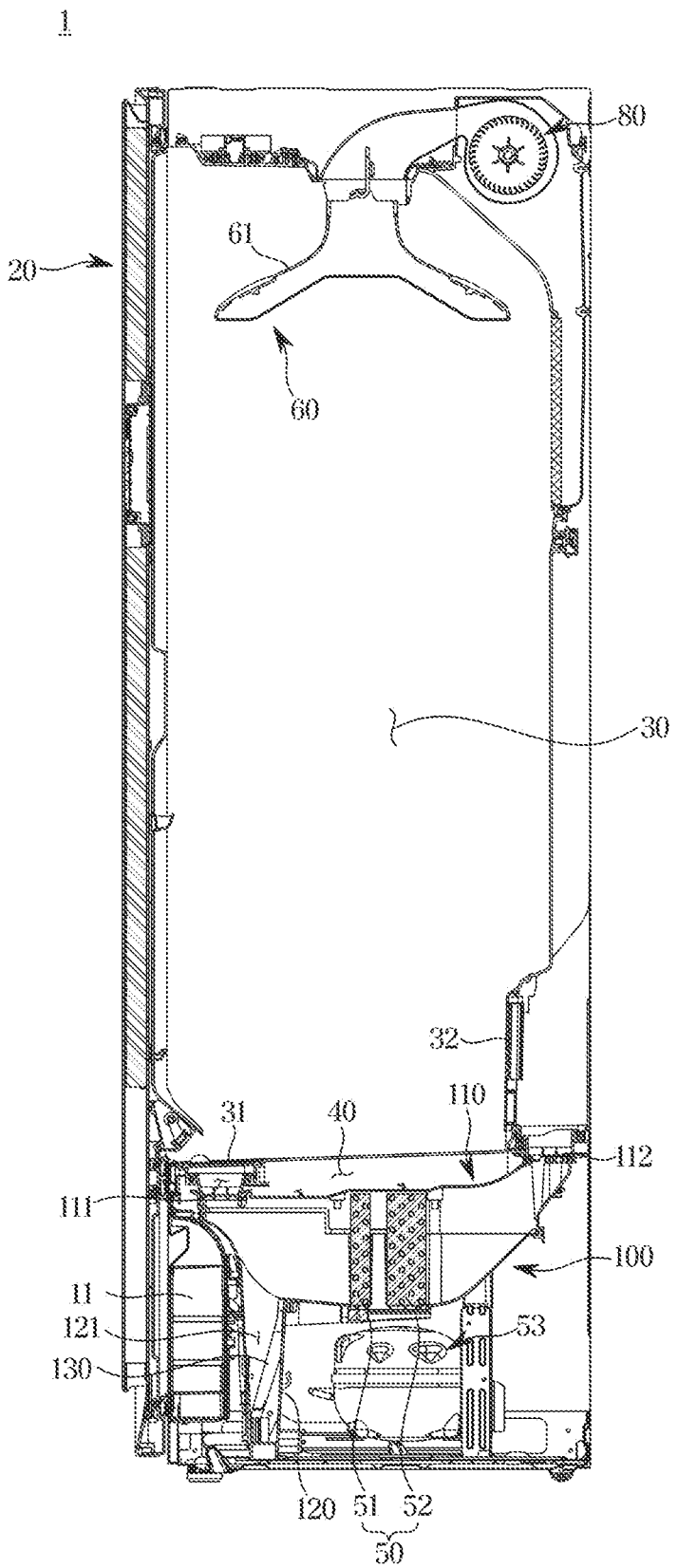
FIG. 3 is a schematic side cross-sectional view of a clothes care apparatus according to an embodiment of the disclosure.

FIG. 1 is a perspective view of a clothes care apparatus according to an embodiment of the disclosure. FIG. 2 shows a state in which a door opens in a clothes care apparatus according to an embodiment of the disclosure. FIG. 3 is a schematic side cross-sectional view of a clothes care apparatus according to an embodiment of the disclosure.

As shown in FIGS. 1 and 2, a clothes care apparatus 1 may include a main body 10 forming an exterior of the clothes care apparatus 1, and a door 20 rotatably coupled to the main body 10.

The main body 10 may be in a shape of a rectangular parallelepiped of which a front side opens. The door 20 may be rotatably coupled to the main body 10 to open or close the open front side of the main body 10.

The main body 10 may include a care room 30 provided inside the main body 10 and configured to accommodate clothes and care the clothes. The door 20 may open or close the care room 30 by opening or closing the open front side of the main body 10.

Referring to FIG. 3, the main body 10 may include a machine room 40 partitioned from the care room 30 and positioned below the care room 30. Inside the machine room 40, a heat exchanger 50, a compressor 53, a water collecting duct 100, a drain pump 90, a steam generator (not shown), etc. may be positioned.

The heat exchanger 50 may include an evaporator 51 for dehumidifying an inside of the care room 30, and a condenser 52 for supplying hot air to the inside of the care room 30. The evaporator 51 and the condenser 52 may be positioned side by side.

The clothes care apparatus 1 may include a clothes support member 60 provided inside the care room 30 to hold clothes.

The clothes support member 60 may be installed on an upper surface of the care room 30. The clothes support member 60 may be separable from the care room 30. At least one or more clothes support members 60 may be provided. The clothes support member 60 may be in a shape of a hanger for hanging clothes.

Air may flow inside the clothes support member 60. Dust or foreign materials gathered on clothes may be removed by air supplied to inside of the clothes support member 60.

In the clothes support member 60, an air hole 61 through which air enters the inside of the clothes support member 60 may be formed. The air hole 61 may be formed at an upper end of the clothes support member 60, and air may be supplied to clothes through the air hole 61.

The care room 30 may include a first outlet 31 and a second outlet 32 for discharging water collected inside the care room 30 to the machine room 40. The first outlet 31 may be located in a lower plate of the care room 30, and the second outlet 32 may be located in a rear plate of the care room 30. Water collected inside the care room 30 may be discharged to the machine room 40 through the first outlet 31 and the second outlet 32.

In certain embodiments, the first outlet 31 and the second outlet 32 will be referred to as outlets in view of having a function of discharging water collected inside the care room 30 to the machine room 40, although the first outlet 31 and the second outlet 32 may have other functions.

The clothes care apparatus 1 may include a drain container 11 and a water supply container 12 that are separable from the main body 10. The drain container 11 and the water supply container 12 may be positioned below the care room 30.

The drain container 11 may store water condensed in the heat exchanger 50, and water formed by being condensed from a steam discharged to the inside of the care room 30 from the steam generator (not shown). The drain container 11 may receive water stored in a sump 120 and store the water.

The water supply container 12 may store water required for the steam generator to generate a steam. Water stored in the water supply container 12 may be supplied to the steam generator and used to generate a steam. The water supply container 12 may be separable from the main body 10 to easily add water.

The drain container 11 and the water supply container 12 may be provided in a front area of the machine room 40. The machine room 40 may be provided in a lower portion of the main body 10. The machine room 40 may be provided below the care room 30.

The heat exchanger 50 may dehumidify and heat inside air of the care room 30. The heat exchanger 50 may supply hot air to the inside of the care room 30. The heat exchanger 50 may include the evaporator 51 and the condenser 52 through which a refrigerant circulates. The evaporator 51 may dehumidify air, and the condenser 52 may heat air.

In the evaporator 51, a refrigerant flowing along the evaporator 51 may be evaporated to absorb latent heat of surrounding air and condense water in air, thereby removing water from the air.

In the condenser 52, a refrigerant flowing along the condenser 52 may be condensed to emit latent air toward surrounding air, thereby heating the surrounding air.

The clothes care apparatus 1 may include a blower 80 for moving inside air of the care room 30. According to an embodiment of the disclosure, the blower 80 may be positioned above the care room 30.

The clothes care apparatus 1 may include the drain pump 90 for transferring water stored in the sump 120 which will be described below to the drain container 11. The drain pump 90 may be positioned in the machine room 40. A first drain pipe 91 may be provided between the drain pump 90 and the sump 120, and a second drain pipe 92 may be provided between the drain pump 90 and the drain container 11.

Figure 4:
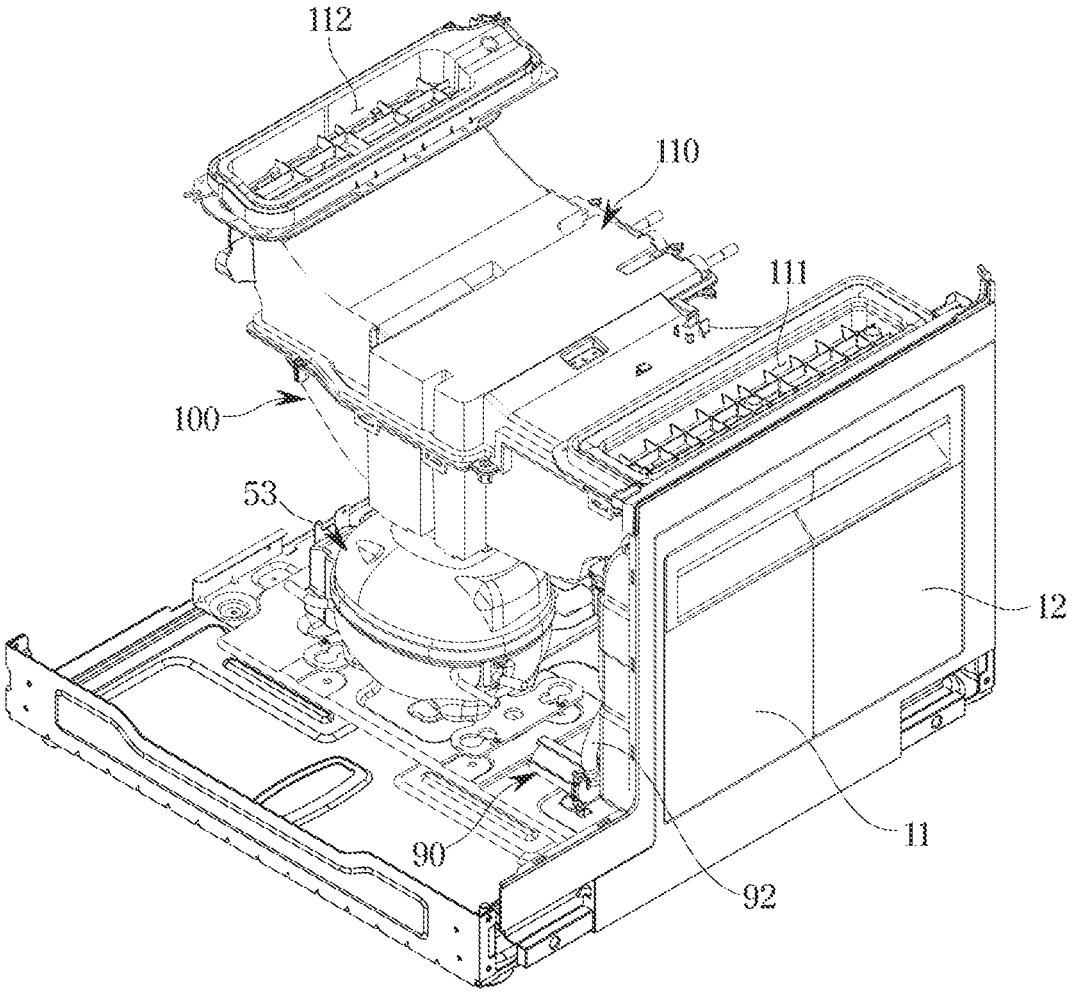
FIG. 4 shows a water collecting duct and components around the water collecting duct positioned inside a machine room, in a clothes care apparatus according to an embodiment of the disclosure.
Figure 5:
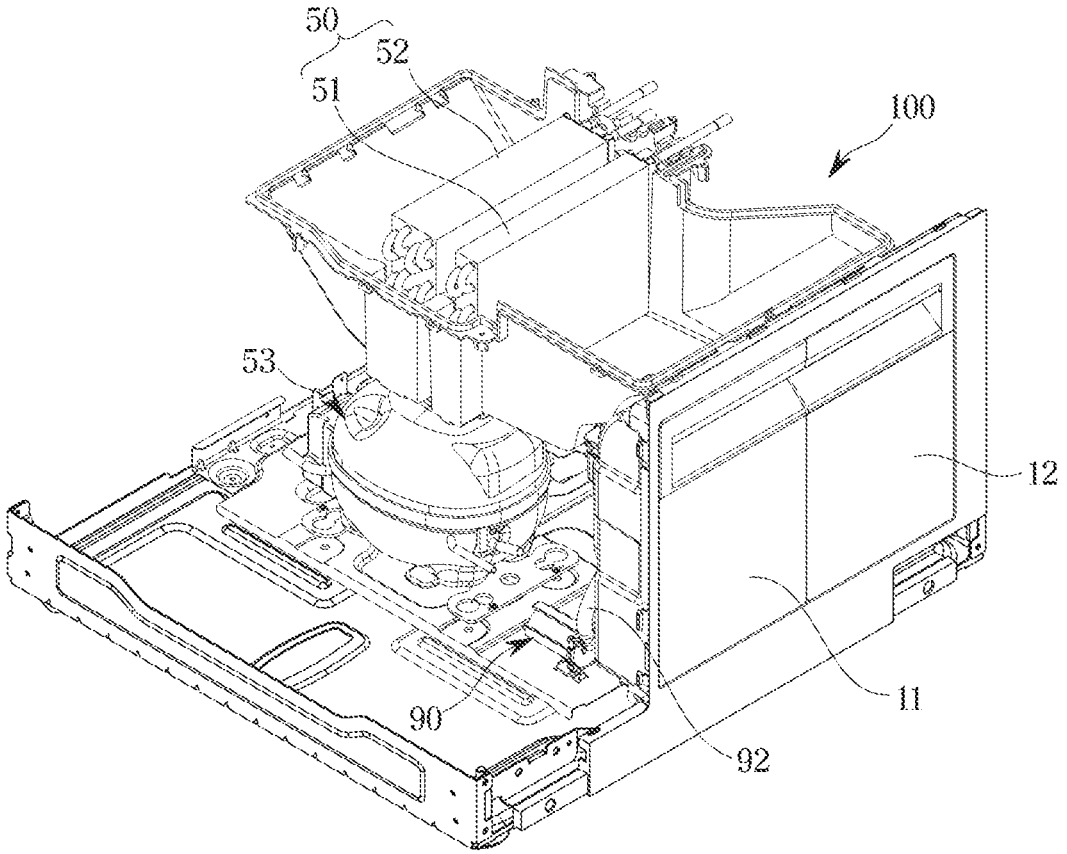
FIG. 5 shows a state after a duct cover is removed from the water collecting duct shown in FIG. 4.

FIG. 4 shows a water collecting duct and components around the water collecting duct positioned inside a machine room, in a clothes care apparatus according to an embodiment of the disclosure. FIG. 5 shows a state after a duct cover is removed from the water collecting duct shown in FIG. 4.

Referring to FIGS. 4 and 5, the clothes care apparatus 1 according to an embodiment of the disclosure may include the water collecting duct 100 for guiding water collected inside the care room 30, and a duct cover 110 covering an open upper side of the water collecting duct 100.

The water collecting duct 100 may be positioned in the machine room 40 to guide water discharged from the care room 30 through the first outlet 31 and the second outlet 32 to the sump 120. Also, the water collecting duct 100 may guide water condensed in the evaporator 51 to the sump 120.

The duct cover 110 may be coupled to the water collecting duct 100 to cover the open upper side of the water collecting duct 100. The duct cover 110 may include a first inlet 111 that receives water discharged through the first outlet 31, and a second inlet 112 that receives water discharged through the second outlet 32. Water received through the first inlet 111 and the second inlet 112 may move to an inside of the water collecting duct 100 by gravity.

Referring to FIG. 5, the water collecting duct 100 according to an embodiment of the disclosure may support the heat exchanger 50. The water collecting duct 100 may support the evaporator 51 and the condenser 52 that are positioned side by side.

Because the water collecting duct 100 is positioned below the evaporator 51 to support the evaporator 51, the water collecting duct 100 may guide water condensed in the evaporator 51 directly to the sump 120.

The water collecting duct 100 may guide water received into the water collecting duct 100 from the care room 30 through the first outlet 31 and the first inlet 111 directly to the sump 120. Also, the water collecting duct 100 may guide water received into the water collecting duct 100 from the care room 30 through the second outlet 32 and the second inlet 112 directly to the sump 120.

According to an embodiment of the disclosure, water condensed in the evaporator 51 and water discharged from the care room 30 to the machine room 40 may be guided by the water collecting duct 100 directly to the sump 120.

In an existing technique, a flow path for guiding water condensed in a heat exchanger to a sump has been separated from a flow path for guiding water discharged from a care room to the sump. In this case, a drain hose for transferring water condensed in the heat exchanger to the sump, or a drain hose for transferring water discharged from the care room to the sump has been needed. According to provision of a drain hose, a separate coupling member for a connection of the drain hose is needed, a number of processes increases, and a management point such as Product Liability (PL) related to leakage is generated.

According to an embodiment of the disclosure, water condensed in the heat exchanger 50 and water discharged from the care room 30 may be guided to the sump 120 through the water collecting duct 100 being a single component. The water collecting duct 100 may guide collected water to the sump 120 through an inclined surface 102 which will be described below, instead of a drain hose. Accordingly, a separate coupling member for a drain hose may be not needed, a number of processes may be reduced, and a management point related to leakage may be reduced. Thereby, productivity of the clothes care apparatus 1 may be improved.

Figure 6:
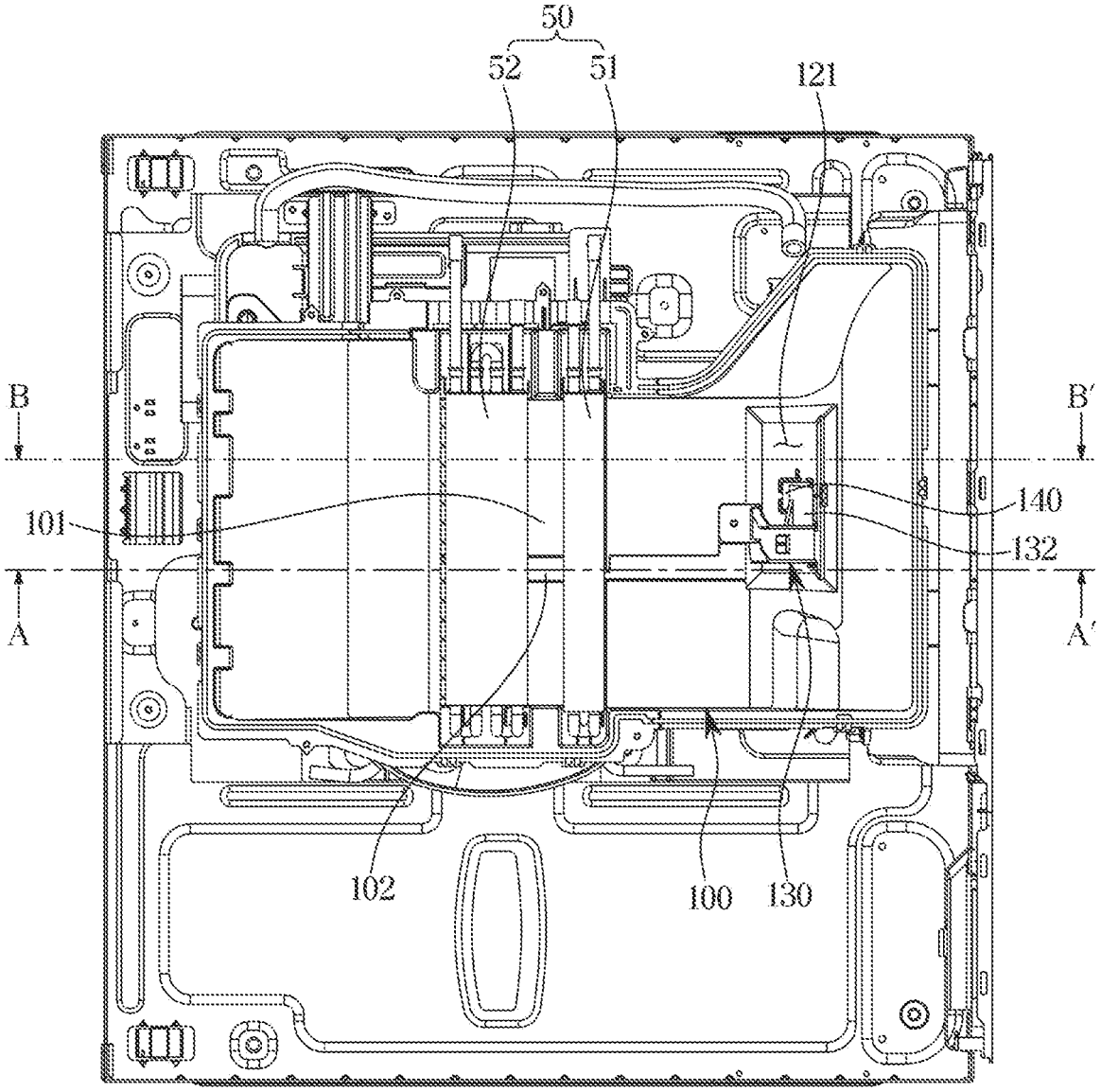
FIG. 6 is a top view showing a water collecting duct and components around the water collecting duct, in a clothes care apparatus according to an embodiment of the disclosure.
Figure 7:
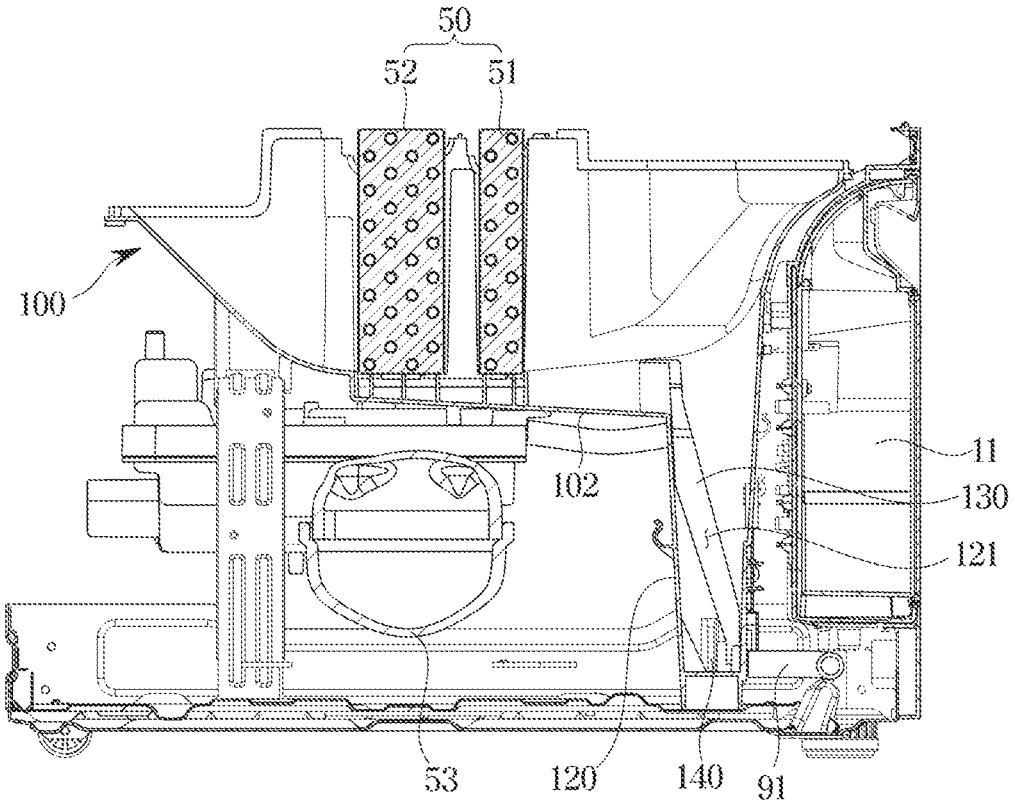
FIG. 7 is a cross-sectional view taken along line A-A' of FIG. 6.

FIG. 6 is a top view showing a water collecting duct and components around the water collecting duct, in a clothes care apparatus according to an embodiment of the disclosure. FIG. 7 is a cross-sectional view taken along line A-A' of FIG. 6.

Referring to FIGS. 6 and 7, the water collecting duct 100 may include a bottom surface 101, and the inclined surface 102 being a portion of the bottom surface 101 and inclined downward toward the sump 120.

Water entered the water collecting duct 100 may be guided to the bottom surface 101 by gravity, and the water guided to the bottom surface 101 may be guided to the inclined surface 102 by gravity. The water guided to the inclined surface 102 may be guided to the sump 120 by gravity.

According to an embodiment of the disclosure, the sump 120 may be integrated into the water collecting duct 100. For example, the sump 120 and the water collecting duct 100 may be integrated into one body by injection-molding or another method.

The sump 120 may protrude from the bottom surface 101 of the water collecting duct 100 toward a bottom surface of the machine room 40. In other words, the sump 120 may be formed by a downwardly protruding portion of the bottom surface 101 of the water collecting duct 100. The sump 120 may form a water storage space 121 therein.

Figure 8:
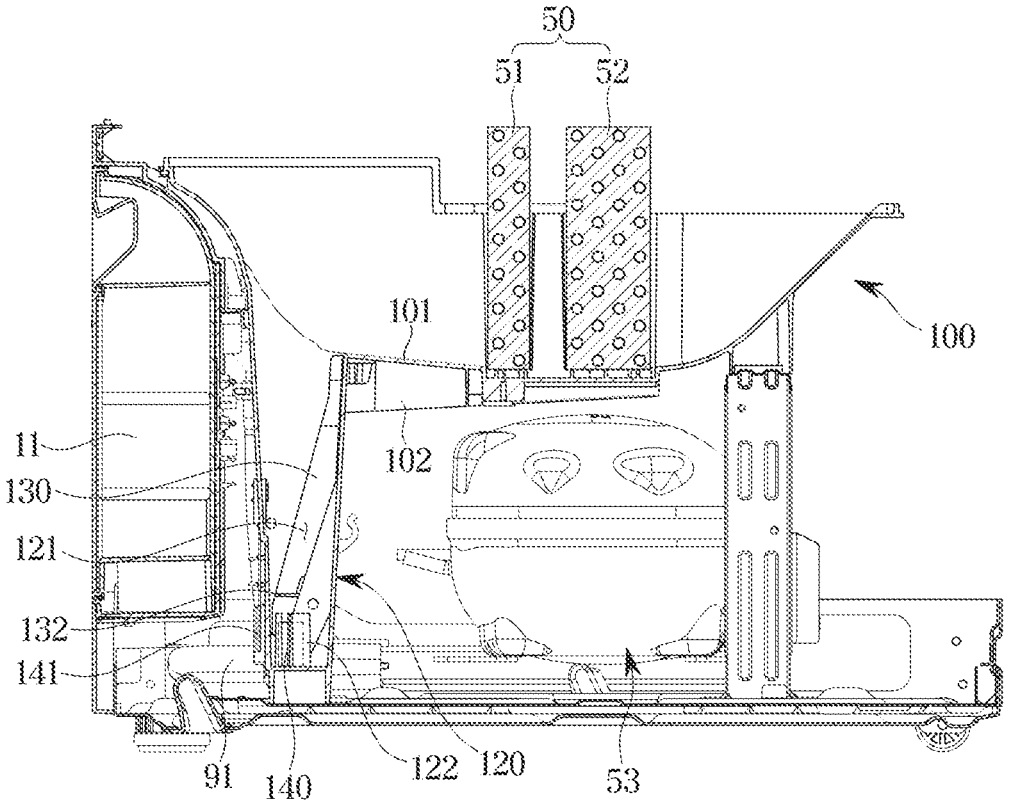
FIG. 8 is a cross-sectional view taken along line B-B' of FIG. 6.
Figure 9:
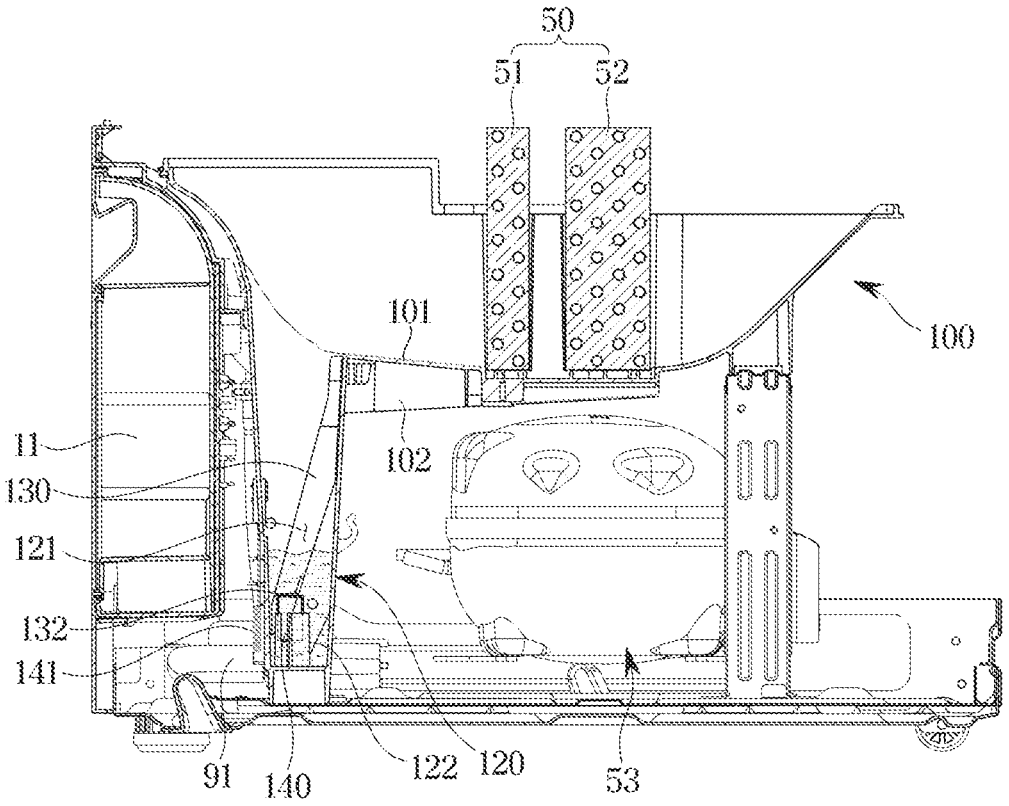
FIG. 9 is a cross-sectional view taken along line B-B' of FIG. 6 after a preset amount of water is filled in a sump.

FIG. 8 is a cross-sectional view taken along line B-B' of FIG. 6. FIG. 9 is a cross-sectional view taken along line B-B' of FIG. 6 after a preset amount of water is filled in a sump.

Referring to FIGS. 8 and 9, the clothes care apparatus 1 may include a floating magnet 140 provided in the sump 120, and a sensor 141 configured to sense a magnetic force of the floating magnet 140. The floating magnet 140 may move up and down inside the sump 120 according to a level of water stored in the sump 120. The sensor 141 may be positioned at a location corresponding to the floating magnet 140, outside the sump 120. According to an embodiment of the disclosure, the sensor 141 may be positioned outside the sump 120 to correspond to a location of the floating magnet 140 positioned on a lower surface of the sump 120 because no water is stored in the sump 120.

The clothes care apparatus 1 may include the drain pump 90 positioned inside the machine room 40, the first drain pipe 91 connecting the sump 120 with the drain pump 90, and the second drain pipe 92 connecting the drain pump 90 with the drain container 11.

According to sensing of an upward movement of the floating magnet 140 by the sensor 141, the drain pump 90 may operate. According to the operation of the drain pump 90, water stored in the sump 120 may move to the drain container 11 via the first drain pipe 91, the drain pump 90, and the second drain pipe 92.

The sump 120 may include a magnet accommodating groove 122 to accommodate the floating magnet 140. The magnet accommodating groove 122 may be formed by a boss portion protruding from the lower surface of the sump 120. The magnet accommodating groove 122 may prevent the floating magnet 140 from moving in a side direction, while guiding the floating magnet 140 to move only in an up-down direction.

Figure 10:
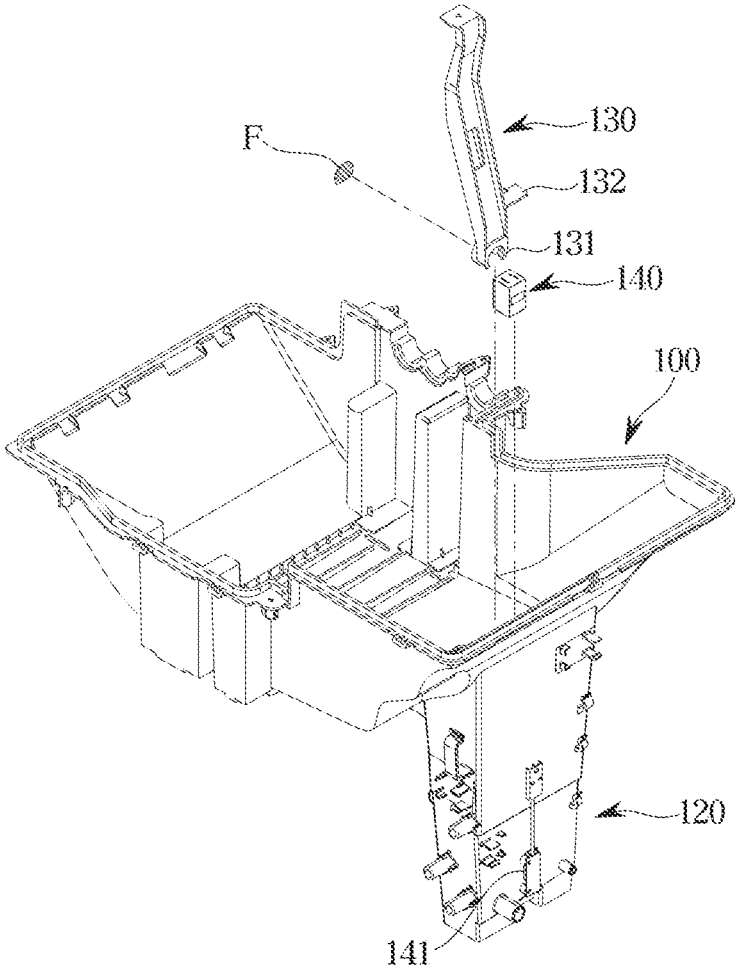
FIG. 10 is an exploded view showing a water collecting duct and components that are coupled to the water collecting duct, in a clothes care apparatus according to an embodiment of the disclosure.

FIG. 10 is an exploded view showing a water collecting duct and components that are coupled to the water collecting duct, in a clothes care apparatus according to an embodiment of the disclosure.

Referring to FIG. 10, a filter accommodating bracket 130 may be coupled to the water collecting duct 100. The filter accommodating bracket 130 may be coupled to the water collecting duct 100 by using a coupling member, although not shown in the drawings.

The filter accommodating bracket 130 may be coupled to the water collecting duct 100 to be positioned inside the sump 120.

The filter accommodating bracket 130 may include a filter accommodating groove 131 that accommodates a filter F for filtering foreign materials included in water stored in the sump 120. The filter accommodating groove 131 may be provided at a lower end of the filter accommodating bracket 130. The filter accommodating groove 131 may be positioned to correspond to a drain hole (not shown) for discharging water stored in the sump 120. The drain hole of the sump 120 may be positioned to be adjacent to the bottom surface of the sump 120, and the drain hole may be connected with the first drain pipe 91.

Because the filter accommodating groove 131 is positioned to correspond to the drain hole of the sump 120, the filter F accommodated in the filter accommodating groove 131 may be positioned to correspond to the drain hole of the sump 120. By the arrangement, foreign materials included in water passing through the drain hole from the sump 120 may be filtered by the filter F.

The floating magnet 140 may be accommodated in the magnet accommodating groove 122, as described above, and move up and down in a state of being accommodated in the magnet accommodating groove 122.

The filter accommodating bracket 130 may include a stopper 132 positioned above the floating magnet 140 to limit an upward movement range of the floating magnet 140. The stopper 132 may be in a shape of a plate protruding in a side direction from the filter accommodating bracket 130, although the shape of the stopper 132 is not limited thereto. The stopper 132 may prevent the floating magnet 140 from departing from the magnet accommodating groove 122 by limiting a movement range of the floating magnet 140.

The sensor 141 may be positioned outside the sump 120, and more specifically, the sensor 141 may be positioned on an outer wall of the sump 120. The sensor 141 may be positioned to correspond to a location of the floating magnet 140 not moved upward. However, the sensor 141 may be positioned to correspond to a location of the floating magnet 140 moved upward and prevented from moving further upward by the stopper 132.

According to an embodiment of the disclosure, according to a contact of the floating magnet 140 to the stopper 132 and preventing of a further upward movement of the floating magnet 140, the sensor 141 may sense an upward movement of the floating magnet 140. The drain pump 90 may be set to operate according to sensing of the upward movement of the floating magnet 140 by the sensor 141.

Figure 11:
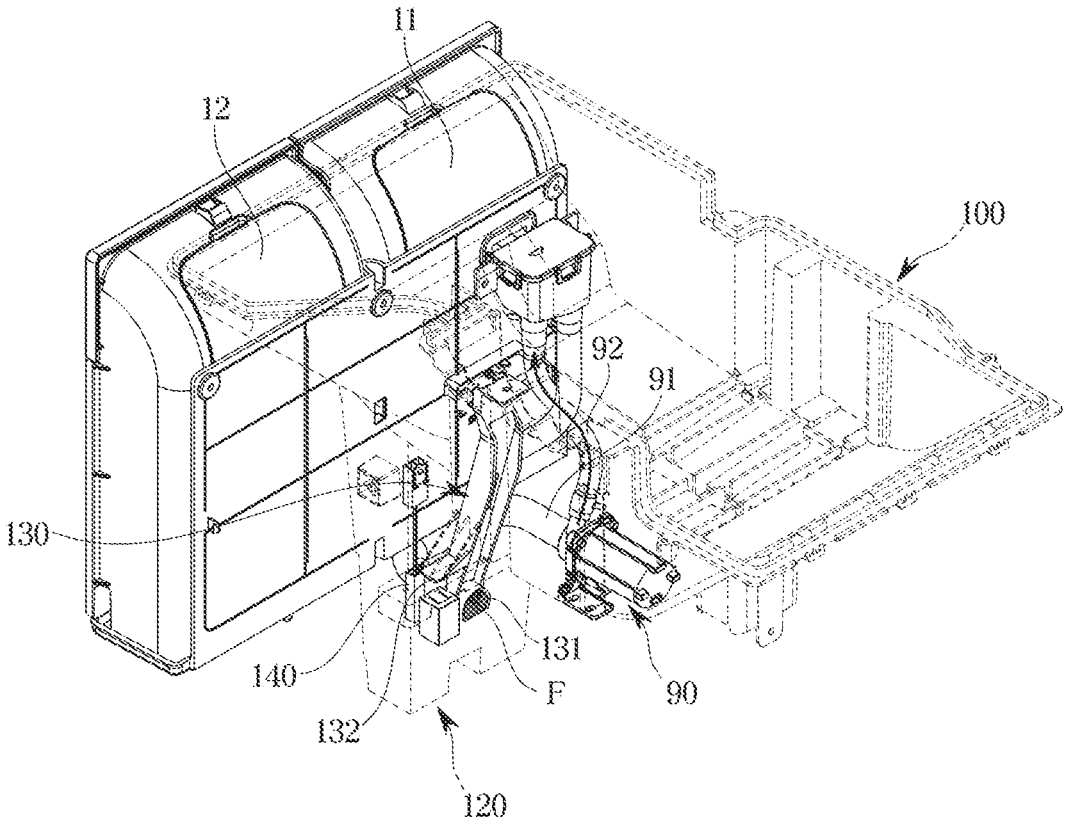
FIG. 11 is a view for describing a relationship between a sump, a drain pump, and a drain container, in a clothes care apparatus according to an embodiment of the disclosure.

FIG. 11 is a view for describing a relationship between a sump, a drain pump, and a drain container, in a clothes care apparatus according to an embodiment of the disclosure.

Referring to FIG. 11, according to sensing of an upward movement of the floating magnet 140 by the sensor 141 and an operation of the drain pump 90, water stored in the sump 120 may pass through the filter F and the drain hole of the sump 120 and enter the drain pump 90 through the first drain pipe 91. The water entered the drain pump 90 may be discharged to the drain container 11 through the second drain pipe 92. Through the process, water stored in the sump 120 may reach a preset amount. In this case, the preset amount of water may be transferred to the drain container 11. A water storage capacity of the drain container 11 may be greater than a water storage capacity of the sump 120. Accordingly, after the drain pump 90 operates several times, the drain container 11 may be full of water.

Figure 12:
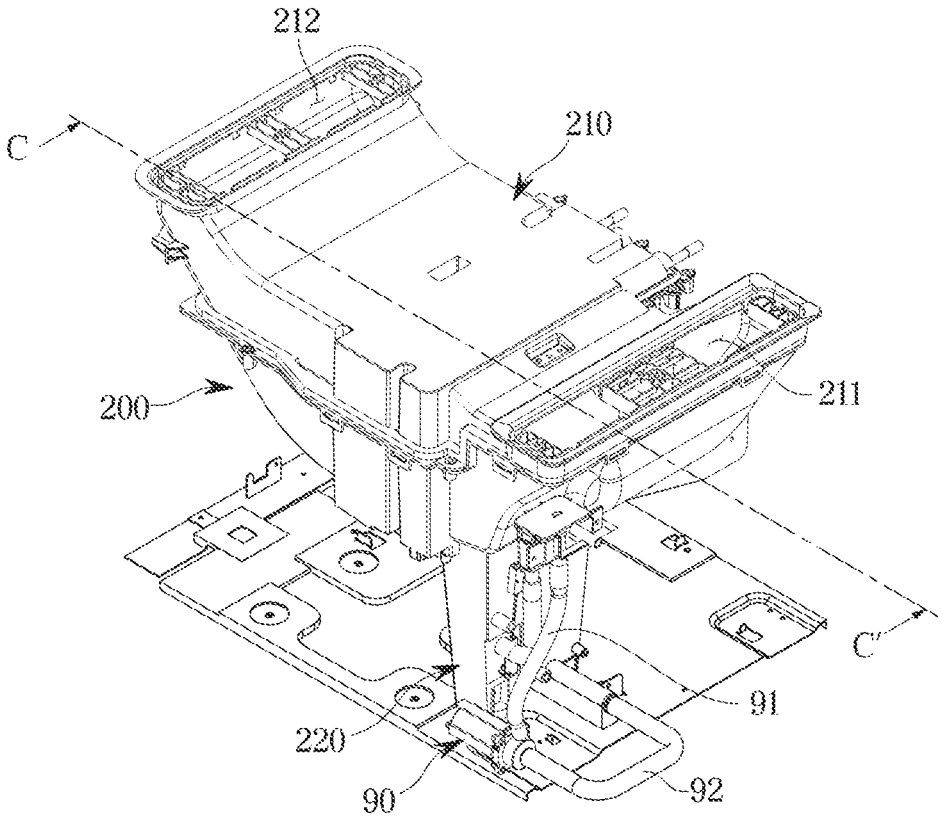
FIG. 12 shows a water collecting duct and components around the water collecting duct, in a clothes care apparatus according to an embodiment of the disclosure.
Figure 13:
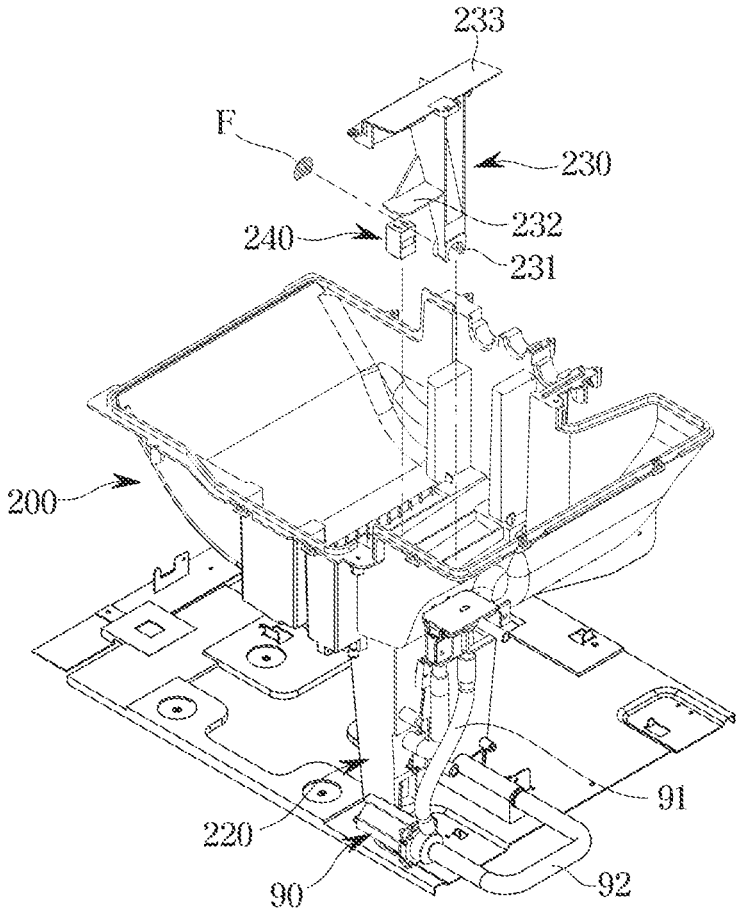
FIG. 13 is an exploded view of components coupled to the water collecting duct, in the water collecting duct shown in FIG. 12.
Figure 14:
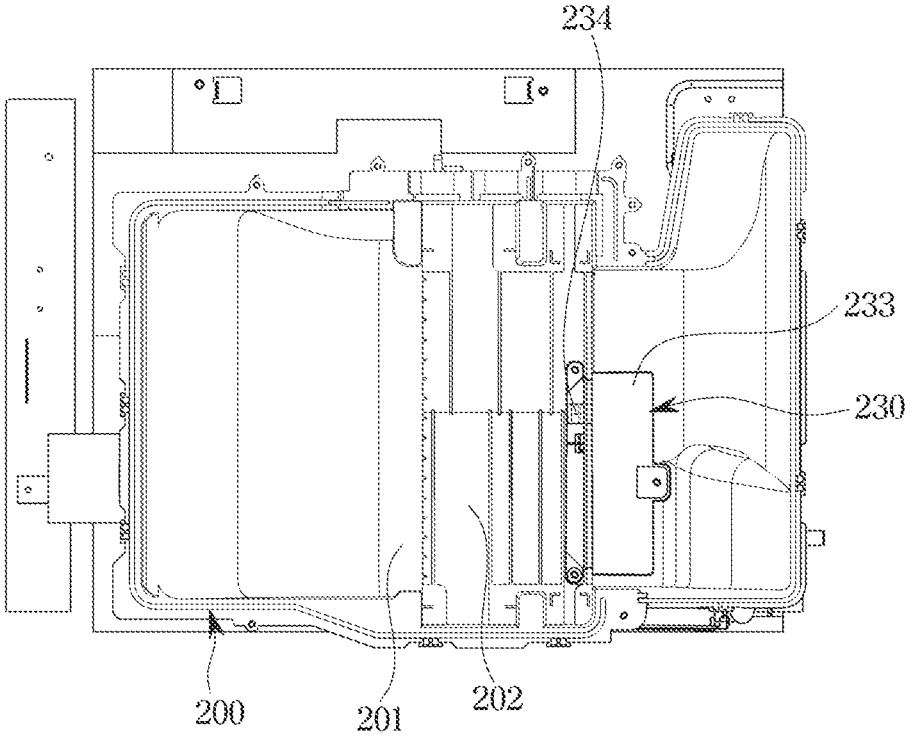
FIG. 14 is a top view of FIG. 12.
Figure 15:
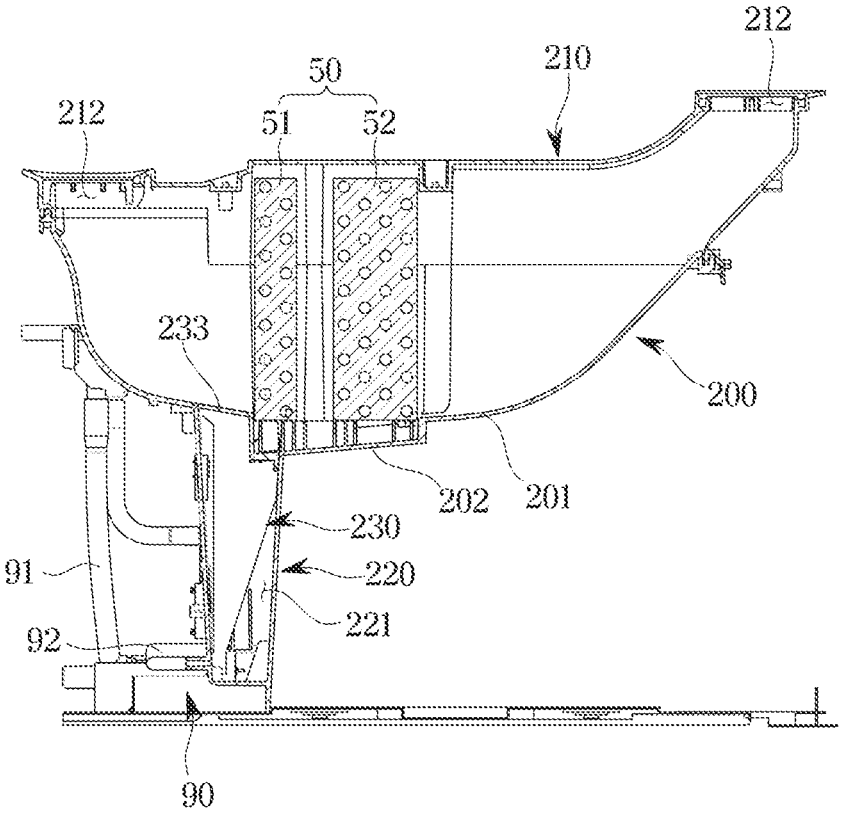
FIG. 15 is a side cross-sectional view taken along line C-C' of FIG. 12.

FIG. 12 shows a water collecting duct and components around the water collecting duct, in a clothes care apparatus according to an embodiment of the disclosure. FIG. 13 shows an exploded view of components coupled to the water collecting duct, in the water collecting duct shown in FIG. 12. FIG. 14 is a top view of FIG. 12. FIG. 15 is a side cross-sectional view taken along line C-C' of FIG. 12.

A water collecting duct 200 according to an embodiment of the disclosure will be described with reference to FIGS. 12 to 15.

Referring to FIG. 12, a duct cover 210 may be coupled to the water collecting duct 200 according to an embodiment of the disclosure. The duct cover 210 may include a first inlet 211 and a second inlet 212. The first inlet 211 may discharge water discharged through the first outlet 31 to the water collecting duct 200, and the second inlet 212 may discharge water discharged through the second outlet 32 to the water collecting duct 200.

Referring to FIG. 13, the water collecting duct 200 according to an embodiment of the disclosure may include a sump 220, a filter accommodating bracket 230, a floating magnet 240, and a sensor.

According to an embodiment of the disclosure, the filter accommodating bracket 230 may include a filter accommodating groove 231 for accommodating a filter F, a stopper 232 for limiting an upward movement range of the floating magnet 240, and a sump cover 233 covering an open upper side of the sump 220.

Referring to FIG. 14, the sump cover 233 may be coupled to the water collecting duct 200 to cover the open upper side of the sump 220. Also, the sump cover 233 may support a portion of the evaporator 51 (see FIG. 15).

The sump cover 233 may be positioned below the evaporator 51 to support at least one portion of the evaporator 51. The sump cover 233 may include a cover hole 234 through which water condensed in the evaporator 51 is discharged to the sump 220. The cover hole 234 may discharge water condensed in the evaporator 51 and water discharged from the care room 30 (see FIG. 3) to the sump 220. The cover hole 234 may be formed by opening a portion of the sump cover 233 located below the evaporator 51.

Referring to FIGS. 14 and 15, the water collecting duct 200 may include a bottom surface 201, and an inclined surface 202 for guiding water entered the water collecting duct 200 or condensed in the heat exchanger 50 to the sump 220. The inclined surface 202 may be inclined downward toward the sump 220.

According to an embodiment of the disclosure, the sump 220 may be positioned below the evaporator 51. In other words, at least one portion of the evaporator 51 may be located above the open upper side of the sump 220. By the structure, water condensed in the evaporator 51 may be discharged directly to the sump 220 through the cover hole 234 provided in the sump cover 233 covering the open upper side of the sump 220.

In the water collecting duct 100 shown in FIGS. 8 and 9, the sump 120 may protrude downward from a portion spaced in the side direction from the evaporator 51. In contrast, in the water collecting duct 200 shown in FIG. 15, the sump 220 may protrude from below the evaporator 51. As such, by changing a position of the sump, a degree of freedom in arrangement of other components installed inside the machine room 40 may be secured.

According to the disclosure, a clothes care apparatus for guiding condensed water generated in a heat exchanger and water generated inside a care room to a sump through a water collecting duct may be provided.

According to the disclosure, a clothes care apparatus capable of reducing management points and improving productivity by omitting a drain hose for guiding condensed water generated in a heat exchanger or water generated inside a care room to a sump may be provided.

So far, specific embodiments have been shown and described. However, the disclosure is not limited to the above-described embodiments, and various modifications can be made by those skilled in the art without departing from the gist of the technical idea of the disclosure defined by the claims below.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothes care apparatus comprising:
- a main body including a care room configured to accommodate clothes, and a machine room positioned below the care room and partitioned from the care room;
- a heat exchanger positioned inside the machine room;
- a water collecting duct configured to guide water condensed in the heat exchanger and water discharged from the care room to the machine room;
- a sump provided in the water collecting duct and configured to store water guided by the water collecting duct; and
- a filter accommodating bracket coupled to the water collecting duct to be positioned inside the sump,
- wherein the filter accommodating bracket comprises a sump cover configured to cover an open upper side of the sump.

2. The clothes care apparatus of claim 1, wherein the water collecting duct is positioned below the heat exchanger and is configured to support the heat exchanger.

3. The clothes care apparatus of claim 1, wherein the water collecting duct is configured to:
- guide the water discharged from the care room to the machine room directly to the sump, and
- guide the water condensed in the heat exchanger directly to the sump.

4. The clothes care apparatus of claim 1, wherein the water collecting duct comprises an inclined surface inclined downward toward the sump to guide the water condensed in the heat exchanger and the water discharged from the care room to the machine room to the sump.

5. The clothes care apparatus of claim 1, wherein the sump is integrated into the water collecting duct.

6. The clothes care apparatus of claim 1, wherein the sump protrudes from a bottom surface of the water collecting duct toward a bottom surface of the machine room.

7. The clothes care apparatus of claim 1, further comprising a floating magnet provided inside the sump and configured to move up and down according to a level of water stored in the sump.

8. The clothes care apparatus of claim 7, further comprising a sensor positioned outside the sump and configured to sense the floating magnet.

9. The clothes care apparatus of claim 8, further comprising:

a drain container detachably coupled to the main body and configured to receive water stored in the sump and store the water; and a drain pump configured to transfer the water stored in the sump to the drain container.

10. The clothes care apparatus of claim 9, wherein according to sensing an upward movement of the floating magnet by the sensor, the drain pump is configured to transfer the water stored in the sump to the drain container.

11. The clothes care apparatus of claim 7, further comprising a filter configured to filter a foreign material included in water stored in the sump.

12. The clothes care apparatus of claim 11, wherein the filter accommodating bracket comprises a filter accommodating groove configured to accommodate the filter and positioned to correspond to a drain hole that discharges the water stored in the sump.

13. The clothes care apparatus of claim 11, wherein the filter accommodating bracket comprises a stopper positioned above the floating magnet and configured to limit an upward movement range of the floating magnet.

14. The clothes care apparatus of claim 1, wherein the sump cover is configured to support a portion of the heat exchanger and comprises a cover hole configured to discharge the water condensed in the heat exchanger to the sump.

* * * * *